US008037630B2

(12) United States Patent
Crookham et al.

(10) Patent No.: US 8,037,630 B2
(45) Date of Patent: Oct. 18, 2011

(54) BRACKET FOR HANGING BANNER ON VERTICAL POLE

(75) Inventors: Joe P. Crookham, Oskaloosa, IA (US); Jeffrey A. Rogers, Oskaloosa, IA (US); Kevin R. Johnson, Oskaloosa, IA (US); Darrin L. Guler, Ottumwa, IA (US); Douglas A. Witt, Cedar, IA (US)

(73) Assignee: Musco Corporation, Oskaloosa, IA (US)

( * ) Notice: Subject to any disclaimer, the term of this patent is extended or adjusted under 35 U.S.C. 154(b) by 657 days.

(21) Appl. No.: 11/531,776

(22) Filed: Sep. 14, 2006

(65) Prior Publication Data

US 2007/0057126 A1 Mar. 15, 2007

Related U.S. Application Data

(60) Provisional application No. 60/717,686, filed on Sep. 15, 2005.

(51) Int. Cl.
*G09F 15/00* (2006.01)

(52) U.S. Cl. ..... 40/607.01; 40/607.13; 40/617

(58) Field of Classification Search ..... 40/607.12, 40/603, 6, 604, 607.01, 607.14; 248/218.4, 248/219.2, 219.4, 220.21, 295.11
See application file for complete search history.

(56) References Cited

U.S. PATENT DOCUMENTS

| | | | | |
|---|---|---|---|---|
| 1,872,682 | A * | 8/1932 | Cockle | 40/603 |
| 3,449,847 | A * | 6/1969 | Howell | 40/601 |
| 3,675,356 | A * | 7/1972 | Gilmoure | 40/604 |
| 4,176,480 | A * | 12/1979 | Euzarraga et al. | 40/780 |
| 5,423,281 | A | 6/1995 | Crookham et al. | |
| 6,493,973 | B1 * | 12/2002 | Nelson | 40/607.12 |
| 6,618,973 | B2 * | 9/2003 | Nelson | 40/604 |
| 7,237,754 | B2 * | 7/2007 | Sparkowski | 248/219.1 |
| 2005/0056744 | A1 * | 3/2005 | Ware et al. | 248/219.4 |

* cited by examiner

*Primary Examiner* — Casandra Davis
(74) *Attorney, Agent, or Firm* — McKee, Voorhees & Sease, P.L.C.

(57) ABSTRACT

An apparatus, method, and system for holding a device along the side of a relatively tall pole. The apparatus includes, in one aspect, a hanger bracket adapted to removably mount to the pole. A frame to which the device can be mounted is attached to the hanger bracket. In one embodiment, the frame has first and second cross-arms and an elongated member spacing the cross-arms from each other. In another aspect, a second hanger bracket can be used to further connect the frame to a pole. A locking device can be used to lock at least one of the hanging brackets to the pole. In a further aspect of the invention, the device is a banner or sheet-like device. In another aspect of the invention, the bracket and/or banner is in combination with the pole and/or device.

33 Claims, 8 Drawing Sheets

BRACKET FOR HANGING BANNER ON VERTICAL POLE

CROSS-REFERENCE TO RELATED APPLICATIONS

This application claims priority under 35 U.S.C. §119 of provisional application Ser. No. 60/717,686 filed Sep. 15, 2005, which application is hereby incorporated by reference in its entirety.

INCORPORATION BY REFERENCE

The following are incorporated by reference in their entirety:

U.S. Pat. No. 5,423,281,

U.S. Publication No. US 2005/0056744 A1.

BACKGROUND OF THE INVENTION

A variety of reasons exist to suspend substantial sized structures along a vertical pole. Examples would be banners, signs, information, and decorations. However, the manner to suspend these things should be practical. It should be economical, flexible, adaptable to different applications, and robust enough for a variety of purposes, including use in outdoors environments.

An example relates to sports field lighting. Such lighting uses relatively tall poles (e.g. 35 feet to over a 100 feet tall) to elevate lights to illuminate large areas such as sports fields. The poles are usually made as small in diameter as possible, for economies in materials and minimization of wind load, especially in outdoor applications. Therefore, the surface of the pole does not present enough area to apply indicia or structures that are intended to be read or comprehended from substantial distances (e.g. sometimes hundreds of feet away).

Furthermore, it is counter-intuitive to add anything to such a pole, other than what might be essential for the functionality of the lights. One cannot add anything that would compromise the structural integrity of the pole. One would stay away from unbalancing the load on the pole. Additionally, great care has to be taken to avoid addition of substantial wind load. Any of these things could result in failure of the pole, especially in outdoor conditions where wind load, as an issue, is well-known in the art.

Musco Corporation, the owner of the present application, has developed one system for mounting things along the side of existing sports poles. U.S. Pat. No. 5,423,281, to inventors Crookham et al., discloses a system of suspending triangular-shaped, thin but rigid, plastic pennants from a pole. A strap is cinched around the pole and holds a bracket through which a rod or tube is held. The pennants, approximately 3' by 5', are hingeably attached at one side of the rod. The hinging allows them to shed the wind. They are light weight. As shown in U.S. Pat. No. 5,423,281, which is incorporated by reference herein, this works well for that type of structure.

However, a need has been identified to hang larger structures or hang them in a different fashion. One example would be a rectangular banner larger than the pendents of the U.S. Pat. No. 5,423,281 patent. Such a banner could be made of thin, light weight, and flexible vinyl or plastic sheeting. Unlike the pennants of the U.S. Pat. No. 5,423,281 patent, it thus needs to be supported at least towards opposite sides or ends.

A need has also been identified for mounting structure that would allow easier attachment and removal of the thing that is suspended and which allows easier attachment or removal of the structure supporting the item on the pole. In other words, a need has been identified for a system that allows temporary mounting of a banner or other item on the pole that utilizes minimal labor, equipment, and tools.

Still further, a need has been identified for such a system that is adaptable to a variety of different things to suspend or applications or situations. For example, there is a need for a mounting structure that can be adjusted in length or size to accommodate different sized banners (or other things) or different mounting points on the pole. It is therefore a principle object, feature, aspect or advantage of the present invention to provide an apparatus, method, system, and kit that solves problems in the art or improves over the state of the art.

For example, the present invention has the following objections, features, aspects or advantages:

a) provides a way to place a substantial sized banner or other device along the side of a relatively tall vertical pole;

b) allows a substantial sized banner or other device to be easily installable yet easily removable;

c) allows a substantial sized banner or other device to be effectively removable for such things as bad weather, to deter vandalism or theft, or for seasonal or periodic changing of banners or other devices on them;

d) efficiently removable for storage;

e) in one aspect, can be removed and effectively stored;

f) does not add substantially to the weight or wind load of a pole; and g) is economical and durable.

These and other objects, features, aspects or advantages of the present invention will become more apparent with reference to the accompanying description and drawings.

BRIEF SUMMARY OF THE INVENTION

The present invention relates to an apparatus, system, method, or kit for suspending items of relatively large size but relatively light weight, along the side of a vertical pole. In one aspect of the invention, a bracket is releasably connectable along the side of a pole and has mounting structure to which can be mounted, an item to be suspended.

In another aspect of the invention, a bracket comprises mounting cross-arms for the item to be suspended in two spaced apart positions, and a middle connecting member. In one embodiment of this aspect of the invention, the middle connecting member can be made of varying or adjustable lengths to allow adjustability of the distance between the cross arms, or can be broken down into shorter lengths when disassembled. Alternatively, a mount for at least one cross arm can be adjusted over a range of positions along the middle connecting member to adjust the distance between cross arms.

In another aspect of the invention, a mounting bracket can include structure allowing it to be releasably connected to two locations along the pole. An optional feature involves the ability to lock the bracket to the pole.

BRIEF DESCRIPTION OF THE EXEMPLARY EMBODIMENTS

For specific examples of the invention, the following drawings will be referred to in combination with corresponding written description.

Figure 5:
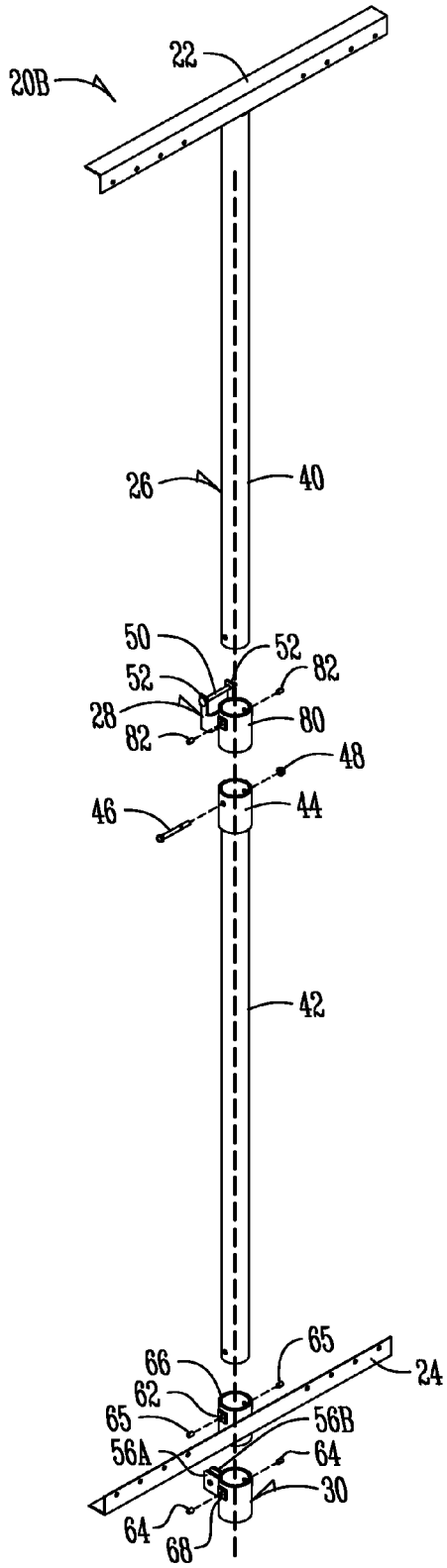
FIG. 5 is similar to FIG. 2 but shows a slightly different alternative exemplary embodiment for the mounting bracket.
Figure 6:
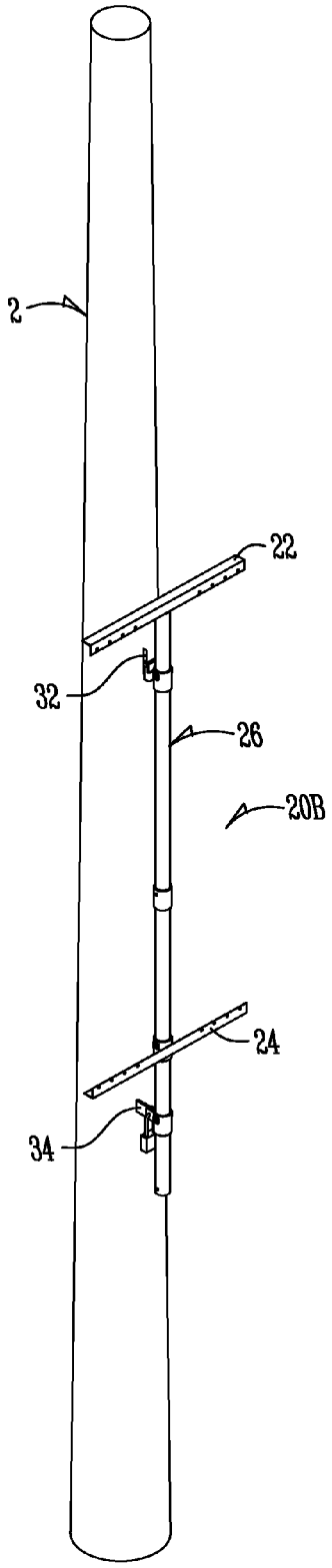
FIG. 6 is a reduced-in-size perspective view showing the embodiment of FIG. 5 installed along a vertical pole.
Figure 7A:
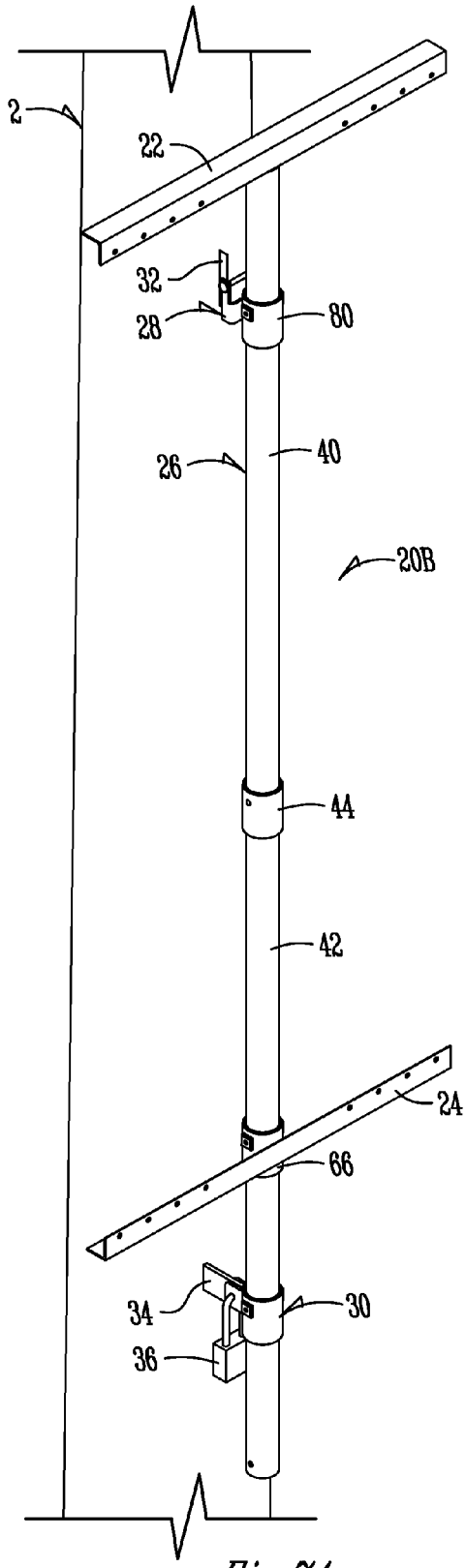
Figure 7B:
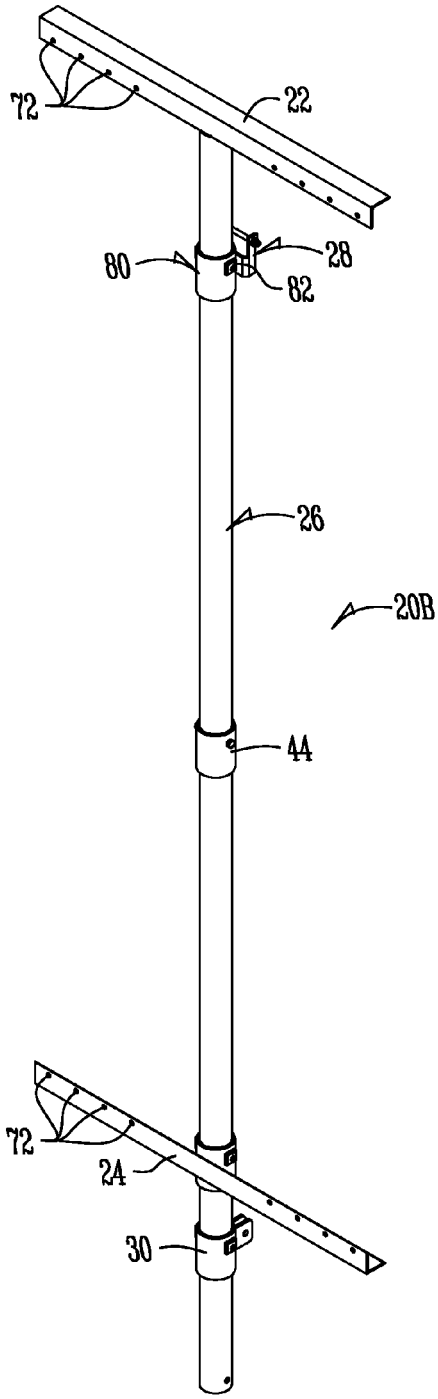
Figure 7C:
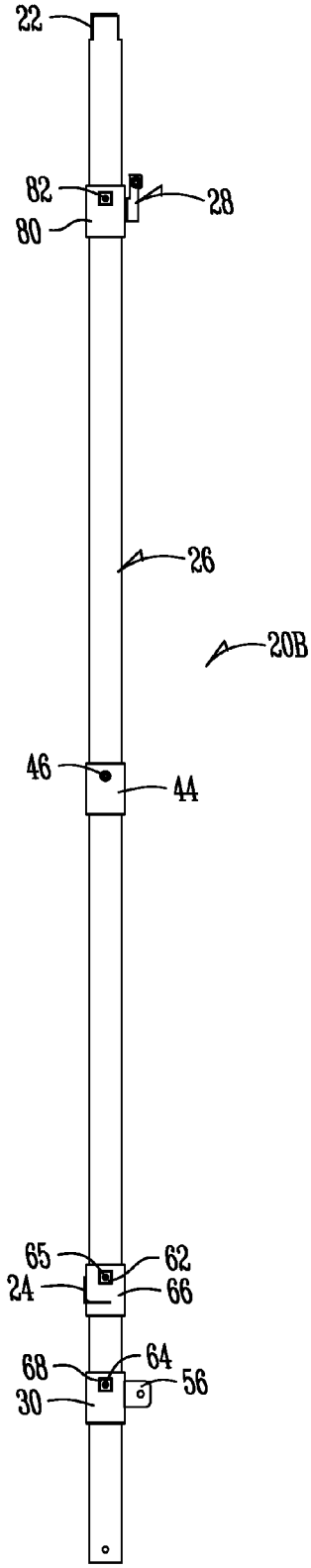
Figure 7D:
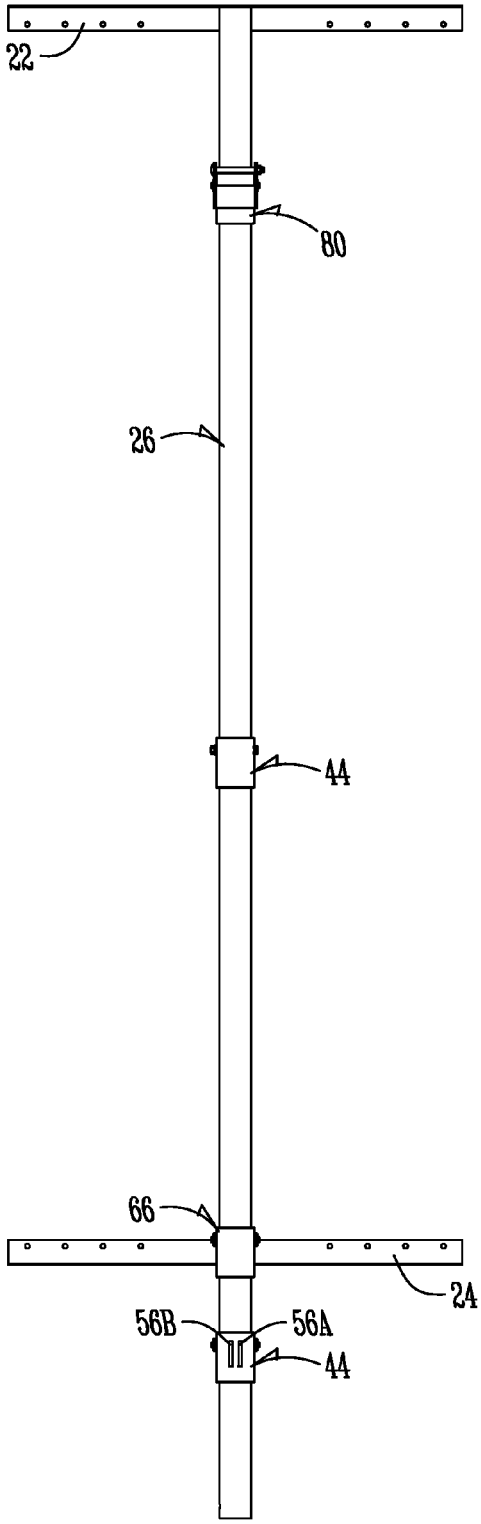
Figure 7E:
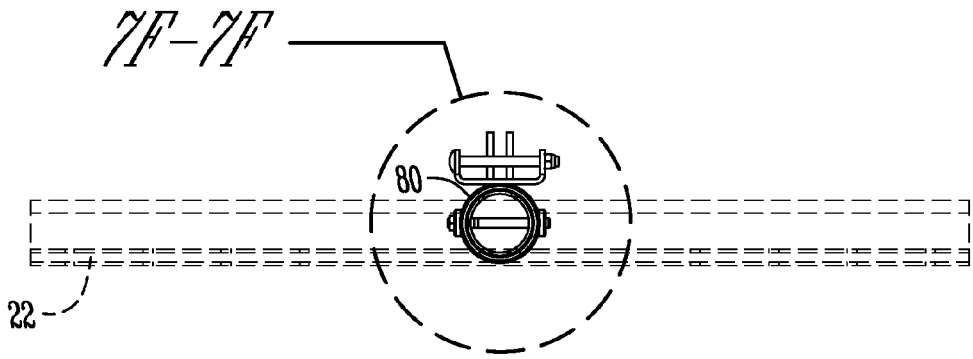
Figure 7F:
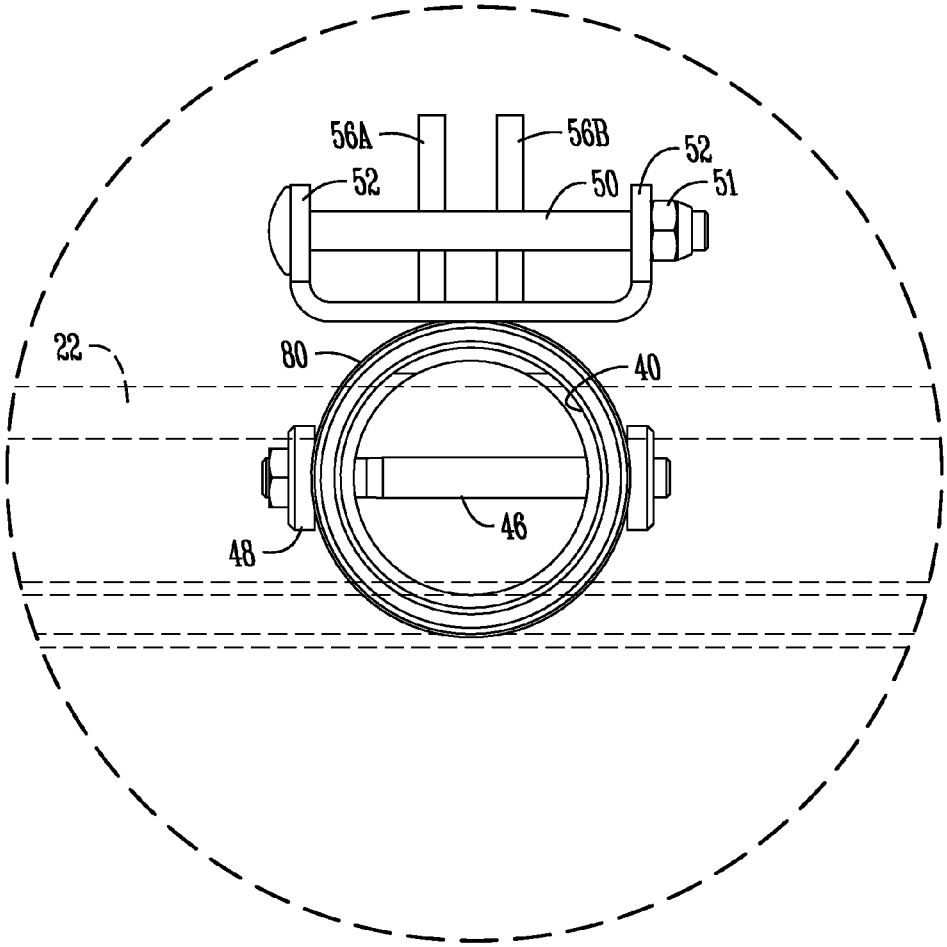

FIGS. 7A-F are multiple isolated views of the bracket of FIGS. 5 and 6.

DETAILED DESCRIPTION OF EXEMPLARY EMBODIMENTS OF THE INVENTION

Overview

For better understanding of the invention, a few examples of how to make and use the invention will now be described in detail. Frequent reference will be made to the appended drawings. Reference numerals will be used in some of the drawings to indicate certain parts and locations in the drawings. The same reference numerals will be used to indicate the same or similar parts or locations throughout all of the drawings unless otherwise indicated.

These examples will be described in the context of mounting items along the side of a sports lighting pole or wide area lighting pole. As can be appreciated, it is applicable to any vertical pole of relatively substantial height. The examples will also be discussed in the context of suspending a flexible vinyl sheet banner. As can be appreciated, other items can be suspended including but not limited to multiple items from the same mounting bracket, light weight rigid items, panels, and perhaps even some lighter weight equipment or functioning devices. These examples are for illustration only and not limitation to the invention.

Example 1

FIGS. 1A-C and 2 illustrate a first exemplary embodiment. Flexible, vinyl banner 12 of several feet in width and several feet in length (for example 6'×6', 8'×8', 10'×10' or a variety of other sizes) is of the type that is light weight and can be rolled up, but is quite durable (including UV light resistant). It can include indicia 100 on it (front, back, or both). Indicia 100 can take the form of letters or words (see reference numeral 100A in FIG. 1A) or any other type of symbol or graphics (indicated grammatically by boxes 100B and 100C in FIG. 1A). Of course, banner 12 itself can be colored, textured, have reflective properties or other visual properties manufactured into the material, or added onto the material.

Figure 1A:
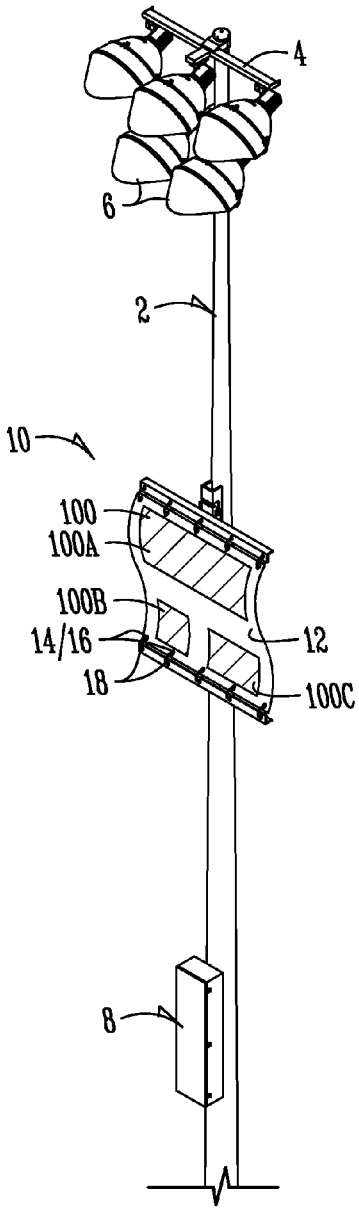
FIG. 1A is a perspective not-to-scale diagrammatic view of one exemplary embodiment of the invention supporting a rectangular, flexible sheet or banner along the side of a light pole.

As illustrated in FIG. 1A banner 12 is mounted or suspended along the side of light pole 2, which typically has cross-arms 4 (e.g. tube, steel) at its upper end that suspend one or more light fixture 6. Sometimes ancillary equipment for operating the lights can be installed along pole 2. FIG. 1A shows ballast box 8, such as is well-known in sports light field.

Banner 12 is part of what will be referred to as banner assembly 10. Banner 12 includes a plurality of holes 14 along top and bottom edges. Brass grommets 16 are placed in those holes.

Figure 1B:
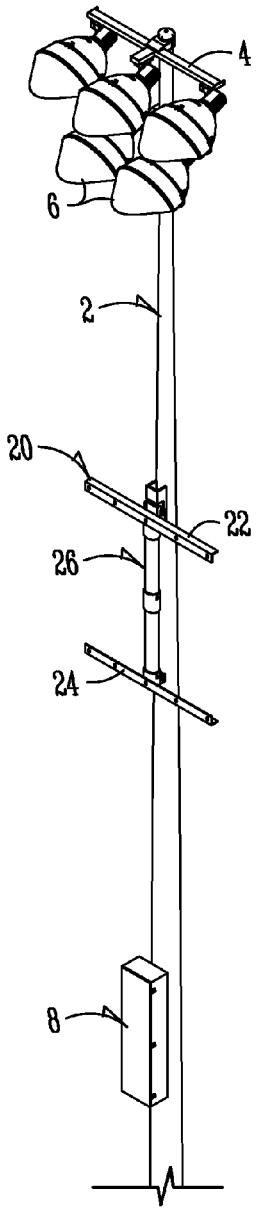
FIG. 1B is similar to FIG. 1A but shows the bracket mounted to the side of the pole without the flexible sheet.
Figure 1C:
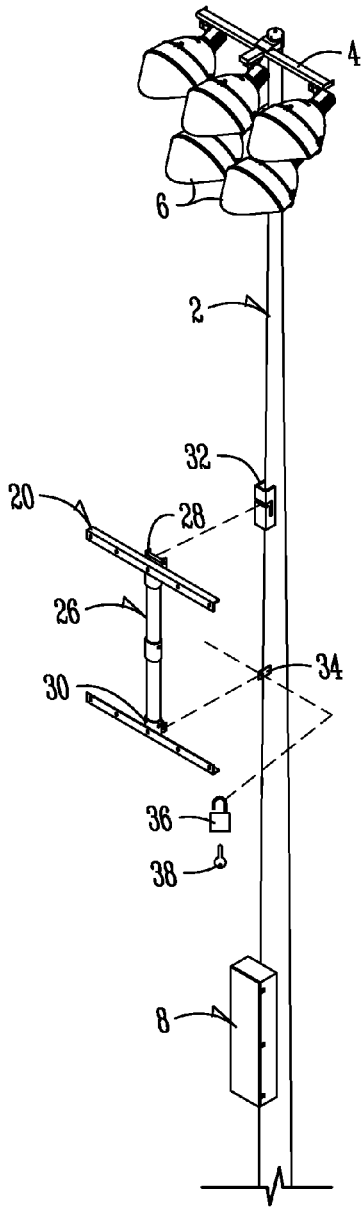
FIG. 1C is similar to FIGS. 1A and 1B but shows in exploded fashion the bracket removed from its mounting structure on the pole.
Figure 2:
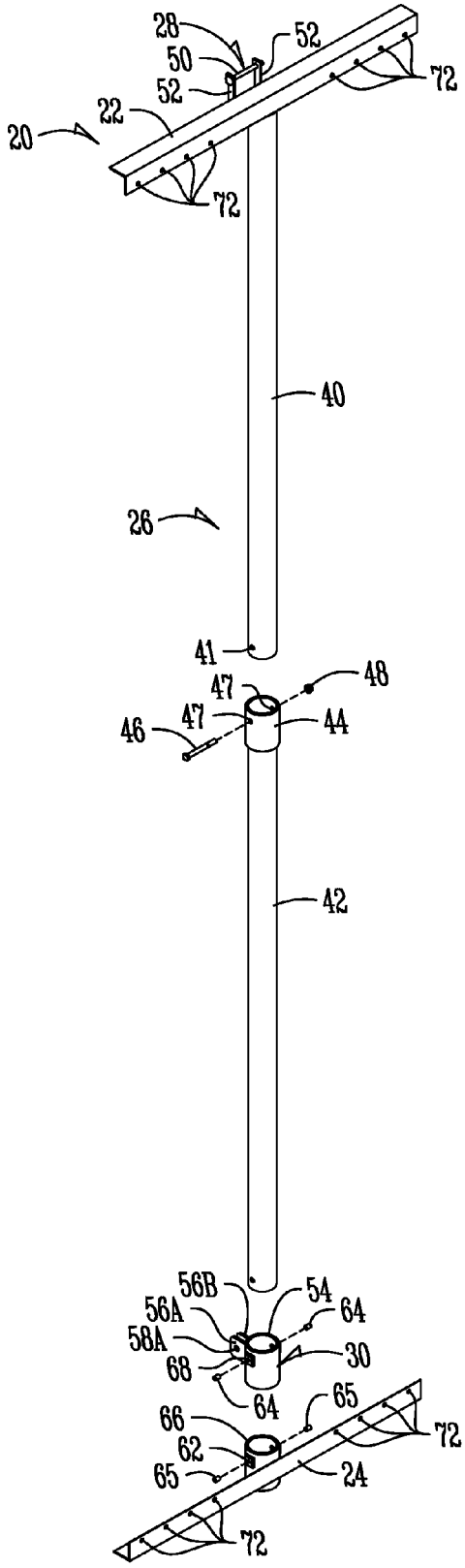
FIG. 2 is an enlarged and to scale exploded perspective view of the bracket of FIG. 1C.

Bracket 20, part of banner assembly 10, is shown in more detail FIGS. 1B, 1C, and 2. A top cross-arm 22 (e.g. 3 feet long angle aluminum) has a plurality of holes 72 that match with holes 14 along one side of banner 12. Bottom cross-arm 24 has similar holes 72 that match with the holes 14 on the other side of banner 12.

A connecting piece or tube 26 (e.g., a few inches diameter aluminum) extends between top and bottom cross-arms 22 and 24. A hanger 28 is fixed at the top of bracket 20 (either welded to or otherwise attached to the top of connecting tube 26 or top cross-arm 22). A bottom sleeve/socket 30 is connected to tube 26 and has structure to allow it to be padlocked to a tab 34 along pole 2. Hanger 28 has a structure that allows it to be hung from a bracket 32 attached along pole 2 (see FIG. 1C).

As illustrated in FIG. 1C, a top receiver bracket 32 is fixed (e.g. welded) along the side of pole 2. Spaced apart and underneath it, and also fixed along pole 2, is an outwardly extending tab 34 with a hole in it. As indicated, hanger 28 would be configured to fit in the receiving slot in pole bracket 32 so that, without tools or any other devices or fasteners, it can simply be inserted in and then pulled down in the inverted L-shaped slot in bracket 32 to hold the top of bracket 20 on pole 2.

Figure 3:
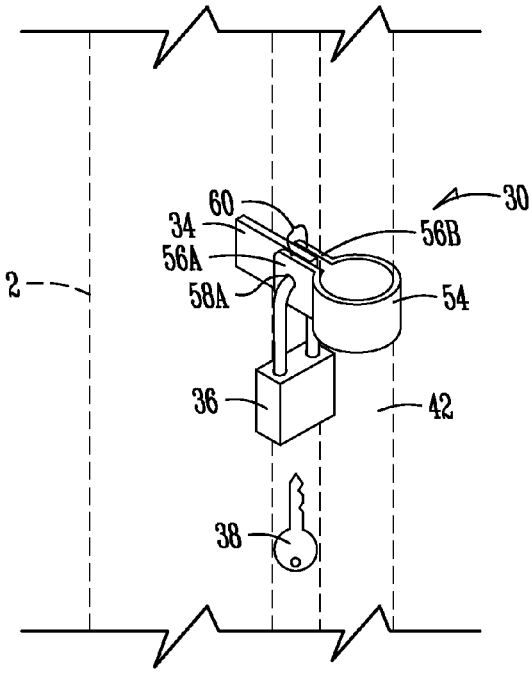
FIG. 3 is a still further enlarged isolated diagrammatic view of structure to removably connect the bottom of the bracket to the pole and also lock it with a pad lock.

Padlock sleeve/socket 30 has two tabs 56A and B extending outwardly from it in a parallel fashion with aligned holes 58A and B in each tab 56A and B (see FIG. 3). Padlock sleeve 30 and tabs 56A and B are configured to fit on opposite sides of pole tab 34, so that holes through all three pieces can be aligned. Padlock 36 can then be installed through the aligned apertures and locked (and then unlocked with key 38). This would lock not only the bottom of bracket 20 but the whole bracket in place on pole 2. Bracket 20 thus would present a light weight but relatively robust, easily installable and removable mount for a banner such as banner 12.

FIG. 2 shows in more detail the structure of this embodiment. Note in particular that hanger 28 has two parallel arms 52 with pin 50 supported by and extending between them. That combination is fixedly mounted to the top of bracket 20. Note also that in this embodiment, connecting tube 26 (e.g. 8 feet total length) (FIG. 1B) is actually made up of two sections, upper section 40 and lower section 42 (FIG. 2). Socket 44 at the top of bottom pole section 42 is fixed in place (e.g. welded) and adapted to slideably receive inside it the bottom of top pole section 40 and releasably lock it in place by bolt 46 and nylon lock nut 48 which fit through aligned holes 41 in the bottom of top section 40 and aligned holes 47 in socket 44 (see FIG. 2). This allows the entire connecting tube 26 to be broken down in smaller pieces for transportation or storage. As can be appreciated, connecting tube 26 can be one piece, or could be two or more pieces by using similar connecting structure.

Note also that padlock sleeve 30 is configured to be slideable along bottom pole section 42 and adjustably fixed in position by set-screws 64. This allows bracket to be easily adjusted for any differences in distance between brackets 32 and 34 (FIG. 1C) from pole to pole. It also provides flexibility in application of bracket 20 to different mounting structures. Bracket 34 on pole 2 is of a size that fits in slot 60 between tabs 56A and B of padlock sleeve 30 (FIG. 3). The body 54 of padlock sleeve 30 is of a diameter to fit around the outside diameter of bottom pole section 42.

Note also that cross-arm sleeve 66 (FIG. 2) attached (e.g. welded) to bottom cross-arm 24 allows bottom cross-arm 24 to be slideably adjusted along bottom pole section 42 and fixed in place by set-screws 65. This not only allows disassembly into smaller parts of bracket 20, but allows adjustability of bottom cross-arm 24 relative to top cross-arm 22 for different sized banners. It allows flexibility no matter what the length of connecting pole or tube 26.

Figure 4:
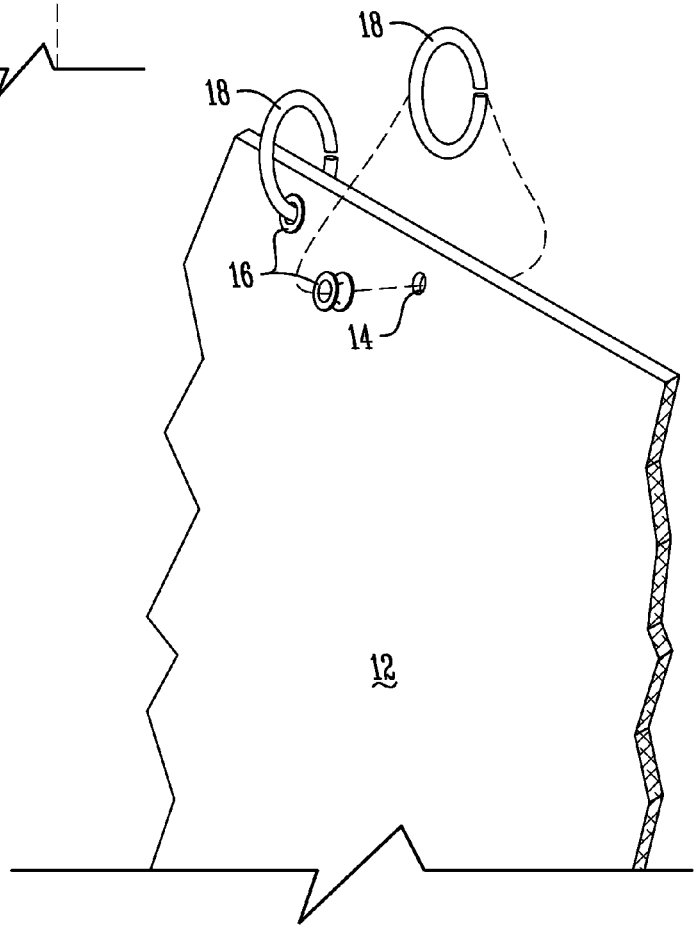
FIG. 4 is an enlarged isolated diagrammatic view of a top edge of the flexible banner sheet of FIG. 1A showing how chain link rings are installed through grommets along that edge, in a manner that can then be connected to the mounting bracket of FIG. 2.

FIG. 4 illustrates in more detail how banner 12 can be connected to top and bottom cross-arms 22 and 24 (FIG. 2) by metal chain links 18 through grommets 16 along top and bottom edges of banner 12. The chain links 18 for the top and bottom edges of banner 12 would be opened slightly and passed through holes 72 in top and bottom cross arms 22 and 24 respectively. Alternative fasteners can be used. Examples include, but are not limited to, cable ties, snap hooks, wire, bungee cords or straps, springs, rope, or bolts. Alternatively, the banner could be connected or fixed directly to the cross-arms.

Bottom cross-arm sleeve 66 can then be locked in place by turning set screw 64 appropriately. Padlock sleeve 30 can be slid onto connecting tube 26 before or after cross-arm sleeve 66. The entire bracket 20 can then be moved to pole 2 and elevated (for example by a worker lifted by a cherry picker, crane or lift vehicle, or even climb a ladder or stand on a raised platform). Pin 50 can be moved into the slot and pole bracket 32 on pole 2. The bottom of bracket 20 can be moved next to pole 2. Padlock sleeve 30 can be slid up along connecting tube 26 until it aligns with tab 34 on pole 2. Padlock 36 can be locked through padlock tabs 56 on padlock sleeve 30 and tab 34. Banner 12 is therefore secured in place along pole 2. Note that it is possible that bracket 20 could be attached to pole 2 by just hanger bracket 28 to pole bracket 32. This would allow bracket frame 22/24/26 to hang from pole 2 by the capture of pin 50 in pole bracket 32. The use of a second hanger bracket, namely padlock sleeve 30 and tabs 56 with pole tab 34 and padlock 36, can releasably attach bracket 20 to another point on pole 2.

As can be appreciated, and as indicated in FIG. 2, the materials used can be robust but of relatively light weight. The flexibility of banner 12 and its connection to cross-arms 22 and 24 would shed or withstand, normally, most environmental conditions except extreme wind, and perhaps hail. One of the advantages of the invention is that the whole banner assembly 10 (FIG. 1A) can be quickly taken down if needed. For example, if a storm is known to be coming, it would not take too much time and resources to take down the banner or even a plurality of such banners. There are other wind shedding or structural techniques used with these types of banners 12 that are known in the art that could also be used.

Brackets 32 and 34 would have to be added to pole 2. This could be done at the manufacturing of the pole or retroactively. Such brackets could be welded in place or otherwise secured. Enclosure hanger 28 could be essentially the same as the hanger bracket 18 shown in FIGS. 1-3 of published application No. US 2005/0056744 A1. Bracket 32 could be essentially the same or similar to bracket 20 in published application No. US 2005/0056744 A1. Examples of mounting of bracket 32 or 34 other than welding would be a strap or cinching member similar to that shown in U.S. Pat. No. 5,423,281 or published application No. US 2005/0056744 A1. A wide variety of methods to attach such brackets are possible.

Also, pin 50 of hanger bracket 28 could be a bolt 50 and nut 51 (FIG. 7E) mounted in aligned apertures at the distal ends of spaced apart arms 52 of bracket 28, like bolt and nut 19 of FIGS. 1 and 11, and bolt and nut 432 and 433 of FIGS. 12A-P of published application No. US 2005/0056744 A1. A bolt and nut would act like a pin to be captured and supported in the slot of the hanger bracket (see slot 28 in FIG. 3A of published application No. US 2005/0056744 A1). But also, once the bolt is captured in the slot, the nut can be tightened to essentially pinch arms 52 of bracket 28 against opposite sides of pole bracket 32 to help hold hanger bracket 28 in place and deter bolt or pin 50 from backing out of being captured. This type of pinching securement is discussed at page 7, paragraphs [0094] to [0102] of published application No. US 2005/0056744 A1.

Example 2

FIGS. 5, 6 and 7A-F show an alternative embodiment of the invention. It is substantially similar to the embodiment shown in FIGS. 1A-C, 2, 3, and 4, except for the following primary differences. As shown in FIG. 5, this embodiment of bracket 20 (indicated by reference numeral 20B), like that of FIG. 2, also has top and bottom cross-arms 22 and 24, two connecting tube members 40 and 42, as well as a slideable cross-arm sleeve 66, and a slideable padlock sleeve 30 which can be secured along bottom tube section 42 as previously described. Bracket 20B, however, has a further sleeve 80, here called hanger sleeve 80, that can be slideably installed along top tube section 40, and which includes the hanger 28. Cross-arm 22 is welded or fixed to the top of tube 40. Hanger sleeve 80 can be adjusted anywhere along tube 40 and secured in place by set-screws 82. This adds another degree of adjustability as compared to the fixed hanger 28 in the embodiment of FIG. 2. FIGS. 6 and 7A-F show different views of the embodiment of FIG. 5, including a diagrammatic illustration of the attachment of brackets 20B to a pole 2.

Options and Alternatives

It will be appreciated that the present invention can take various forms and embodiments. Variations obvious to those skilled in the art will be included within the scope of invention.

Embodiments based on the invention can take various forms and configurations. They can vary in dimensions. For example, a typical banner for a sports pole might be 6', 8' 10' or even more feet in length. This could vary however, as well as the width.

The drawings illustrate exemplary dimensions and structural characteristics. These can vary according to need and desire. One example is chain links 18. In this embodiment they are metal ¼" chain links. This could vary.

As mentioned, the uses of bracket 20 can vary. As previously mentioned, the exemplary embodiments primarily discuss suspending a sheet-like device. As can be appreciated, this can be a conventional banner such as are seen hanging on street light poles with seasonal information or indicia, or information about events related to municipalities or communities. The sheet-like device can be flexible fabric with colors, wording, graphics and designs, cut-outs, overlays, and sometimes even lighting or three dimensional or quasi-three dimensional objects. Alternatively, a sheet-like device can be made to simulate a fabric banner. Examples range from a flexible vinyl to a more rigid plastic, and even to sheet metal or combinations or laminations of materials. Banners 12 can contain information, advertising, promotional material, team names and colors, fund raising information, etc. But further, the sheet-like device could be semi-rigid or rigid, such as a plastic panel, metal panel or sheet, or a wood panel or sheet (e.g. plywood), or combinations of the same. Still further, the framework 22/24/26 could take different forms and embodiments. It does not have to have cross-arms and a central spine. Also, the framework 22/24/26 could be used to hang or suspend non-sheet like devices along the side of a pole. For example, it could be used to suspend three-dimensional holiday ornaments or lights such as are typically done by municipalities during Christmas time, as but one example.

As can be appreciated, the examples 1 and 2 are easily and efficiently removable and installable onto poles. Hanger bracket 28 or 50/52 serve not only as a hanger bracket from which the whole banner and banner bracket can be initially hung and supported, but also as a locater device to assist the worker to accurately position that combined assembly relative the pole without tools or measuring or other alignment steps. Then, if the lower hanging bracket 30 is utilized, the entire frame (cross-arms 22 and 24, with elongated interconnecting piece 26) can simply be swung down to align tabs 56 with tab 34 on pole 2 to fix the lower end of the banner and brackets to pull it (padlock 36 or other locking mechanism could be used to lock it into place). Also, the entire assembly can be removed in reverse fashion and easily and quickly taken off pole 2. The arrangement can also efficiently and quickly be moved to storage. Furthermore, it can be easily and quickly disassembled. For example, banner could be relatively easily and quickly removed from the banner bracket 20. Alternatively, the whole assembly, with banner attached, could be stored. Still further, top part 40 of the connecting member 26 could be released from socket 44 and sleeve 66 unfastened from lower section 42 and slid off of lower section 42 such that vertical part of the banner bracket 20 could be disassembled into two shorter pieces and the banner folded up or otherwise stored.

The ease of removeability of bracket 20 allows them to be taken down in bad weather or to deter vandalism or theft. They can also simply be temporarily placed (e.g. for certain season(s) only).

The length of connecting tube 26 or any of its sub-pieces, if it has sub-pieces, can vary.

Cross arms 22 and 24 do not necessarily have to be straight. They could be curved or non-linear in multiple directions.

The embodiments in the drawings are relatively lightweight (on the order of 10 lbs.). However, poles of these types can usually support higher weights, but it is preferred to keep it as low as possible.

Boss plates 62 and 68 can be incorporated on the outside of sleeves 30 and 66, respectively, to strengthen the area and provide internally threaded apertures for operative use with set screws 65 and 64, respectively. Similar boss plates can be used on sleeve 80 with set screws 82.

The banner assembly could be sold as a kit. It could contain a banner 12, and a bracket 20 having at least two separable sections of connecting tube 26, as well as the mounting structure to connect banner 12 to cross arms 22 and 24, and pieces 32 and 34 for connection to pole 2, as well as the other parts shown in the drawings to allow adjustability of distance between cross arms 22 and 24 and distance between hanger 28 and padlock sleeve 30.

What is claimed:

1. An apparatus for holding a device along a side of a pole, the apparatus comprising:

a. a frame comprising an elongated member and first and second mounts along the elongated member to which a device to be elevated on a pole can be mounted;

b. a first hanger bracket at a first position along the frame and adapted to releasably mount the first hanger bracket to a pole; and c. a second hanger bracket at a second position along the frame and adapted to relcasably connect the second hanger bracket to a pole;

d. structure on at least one of the first and second hanger brackets allowing adjustability along the elongated member of the frame.

2. The apparatus of claim 1 in combination with a device, wherein the device comprises a banner or sheet-like device.

3. The apparatus of claim 1 wherein the banner comprises indicia.

4. The apparatus of claim 3 wherein the indicia comprises at least one of a color, letter, number, design, cut-out, overlay, or combination of the two or more of the same.

5. The apparatus of claim 1 in combination with a pole.

6. The apparatus of claim 5 further comprising a locking device in operative engagement between the frame and the pole.

7. The apparatus of claim 6 wherein the locking device is a padlock.

8. An apparatus for holding a device along a side of a pole, the apparatus comprising:

a. a hanger bracket adapted to removably mount to a pole, the hanger bracket comprising a pin;

b. a frame to which a device can be mounted, the frame attached to the hanger bracket and comprising:

i. first and second cross arms, and ii. an elongated member to which the cross arms are mounted in spaced apart positions from one another;

c. a receiver adapted for mounting on the side of a pole, the receiver including a slot which mateably receives and captures the pin of the hanger bracket.

9. An apparatus for holding a sheet of material along the side of a pole comprising:

a. an elongated member having first and second ends;

b. two cross arms on the elongated member, one cross arm adjustably fixed along the elongated member wherein the sheet material is connected between the cross arms;

c. a pole mounting bracket connected to one of the elongated member or a cross arm and having structure allowing it to removably mount along a pole, wherein the bracket is adjustably fixed along the elongated Member.

10. The apparatus of claim 9 wherein one of the cross arms is fixed along the elongated member.

11. The apparatus of claim 9 further comprising a second mounting bracket on the elongated member.

12. The apparatus of claim 11 wherein the second mounting bracket is adjustable along the elongated member.

13. The apparatus of claim 9 wherein the elongated member comprises a plurality of pieces.

14. The apparatus of claim 13 wherein the plurality of pieces are releasably fixed in position.

15. The apparatus of claim 9 wherein the mounting bracket cooperates with the receiver on a pole.

16. The apparatus of claim 9 wherein the sheet material is flexible.

17. The apparatus of claim 9 wherein the sheet material is substantially rigid.

18. An apparatus for holding a device along a side of a pole, the apparatus comprising:

a. a sports lighting pole;

b. a hanger bracket adapted to removably mount to the pole, the hanger bracket comprising a pin;

c. a receiver adapted for mounting on the side of the pole, the receiver including a slot which mateably receives and captures the pin of the hanger bracket;

d. a frame to which a device can be mounted, the frame attached to the hanger bracket and comprising:

i. first and second cross arms, and ii. an elongated member to which the cross arms are mounted in spaced apart positions from one another; and e. the device comprising a banner or sheet-like device.

19. The apparatus of claim 18 wherein the banner or sheet-like device comprises a flexible material.

20. The apparatus of claim 18 wherein the banner or sheet-like device comprises a substantially rigid material.

21. The apparatus of claim 18 wherein the elongated member comprises two pieces that can be disassembled.

22. The apparatus of claim 18 further comprising a connecting member mounted on the first and second cross arms and adapted to connect the banner or sheet-like device to the first and second cross-arms.

23. The apparatus of claim 18 wherein the banner comprises indicia.

24. The apparatus of claim 23 wherein the indicia comprises at least one of a color, letter, number, design, cut-out, overlay, or combination of the two or more of the same.

25. The apparatus of claim 18 further comprising a locking device in operative engagement between the frame and the pole.

26. The apparatus of claim 25 wherein the locking device is a padlock.

27. An apparatus for holding a device along a side of a pole, the apparatus comprising:

a. a hanger bracket adapted to removably mount to a pole, the hanger bracket comprising a pin;

b. a receiver adapted for mounting on the side of the pole, the receiver including a slot which mateably receives and captures the pin of the hanger bracket;

c. a frame to which a device can be mounted, the frame attached to the hanger bracket and comprising:

i. first and second cross arms, and ii. an elongated member to which the cross arms are mounted in spaced apart positions from one another.

28. An apparatus for holding a sheet of material along the side of a pole comprising:

a. an elongated member having first and second ends;

b. two cross arms on the elongated member, one cross arm adjustably fixed along the elongated member wherein said sheet material is connected between the cross arms;

c. a pole mounting bracket connected to one of the elongated member or a cross arm and having structure allowing it to removably mount along a pole, further comprising a second mounting bracket on the elongated member, wherein the second mounting bracket is adjustable along the elongated member.

29. The apparatus of claim 28 wherein one of the cross arms is fixed along the elongated member.

30. The apparatus of claim 28 wherein the second mounting bracket is adjustably fixed along the elongated member.

31. An apparatus for holding a sheet of material along the side of a pole comprising:

a. an elongated member having first and second ends, wherein the elongated member comprises a plurality of pieces b. two cross arms on the elongated member, one cross arm adjustably fixed along the elongated member wherein said sheet material is connected between the cross arms;

c. a pole mounting bracket connected to one of the elongated member or a cross arm and having structure allowing it to removably mount along a pole.

32. The apparatus of claim 31 wherein one of the cross arms is fixed along the elongated member.

33. The apparatus of claim 31 wherein the bracket is adjustably fixed along the elongated member.

* * * * *

UNITED STATES PATENT AND TRADEMARK OFFICE

CERTIFICATE OF CORRECTION

PATENT NO. : 8,037,630 B2
APPLICATION NO. : 11/531776
DATED : October 18, 2011
INVENTOR(S) : Joe P. Crookham et al.

It is certified that error appears in the above-identified patent and that said Letters Patent is hereby corrected as shown below:

Column 8, line 41
DELETE: after elongated "Member"
ADD: after elongated --member--

Signed and Sealed this
Twentieth Day of December, 2011

David J. Kappos
*Director of the United States Patent and Trademark Office*